United States Patent [19]

Wiener, Jr.

[11] 3,981,091

[45] Sept. 21, 1976

[54] PICTURE FRAME CONSTRUCTION

[76] Inventor: Samuel G. Wiener, Jr., 451 W. Broadway, New York, N.Y. 10012

[22] Filed: Oct. 7, 1974

[21] Appl. No.: 512,494

[52] U.S. Cl. ..... 40/152.1; 40/156

[51] Int. Cl.[2] ..... G09F 1/12

[58] Field of Search ..... 248/473, 490, 488; 40/152.1, 156, 155

[56] References Cited

UNITED STATES PATENTS

| | | | |
|---|---|---|---|
| 2,403,491 | 7/1946 | Bogia | 40/152.1 |
| 2,524,647 | 10/1950 | Baldwin | 248/473 X |
| 2,854,774 | 10/1958 | Horwitt | 40/155 |
| 2,885,166 | 5/1955 | Lehni et al. | 248/490 |
| 3,541,714 | 11/1970 | Bruck | 40/156 |
| 3,867,774 | 2/1975 | Kise | 40/155 |

*Primary Examiner*—Louis G. Mancene
*Assistant Examiner*—Wenceslao J. Contreras
*Attorney, Agent, or Firm*—Charles E. Temko

[57] ABSTRACT

An improved picture frame construction of a type including a transparent front panel and a corresponding rear panel placed in a congruent relation therewith to enclose a picture or print, and means interconnecting the edges of the juxtaposed panels to maintain them together. In one embodiment of the invention, the device includes a plurality of resilient retaining elements having a channel member gripping the edges of the panels, and a hooked member engaging circular openings in the rear panel, all of which may be formed as a single stamping operation. Release of the retaining elements is accomplished by lifting the hooked member from the engagement with the opening, using a manually engageable tab provided for that purpose. In a modified form of the embodiment, a separate opening-forming member is adhesively secured to the exposed surface of the rear panel. In a second embodiment, pairs of opposed retaining members are resiliently linked by a ball chain to provide an equivalent result.

2 Claims, 11 Drawing Figures

FIG. 1
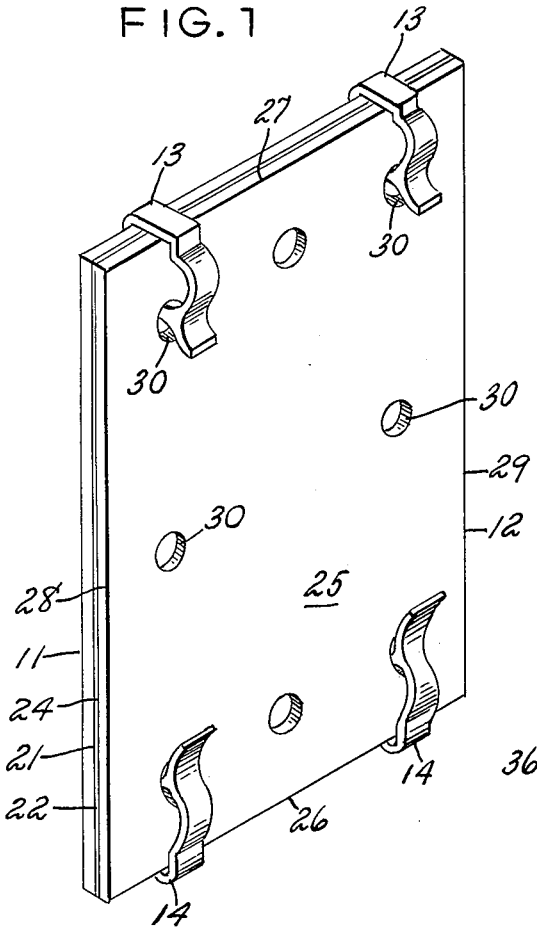
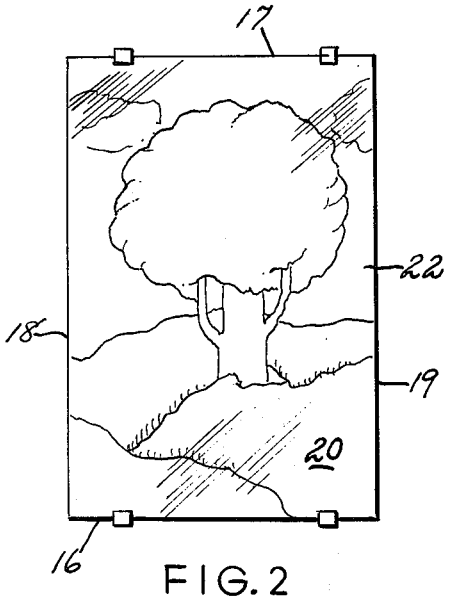
FIG. 2
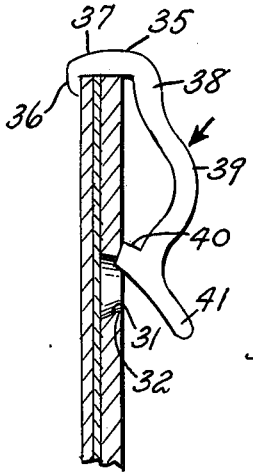
FIG. 3
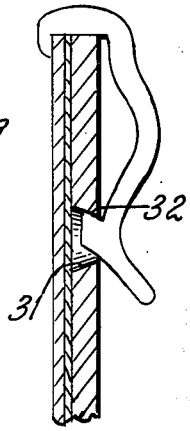
FIG. 4
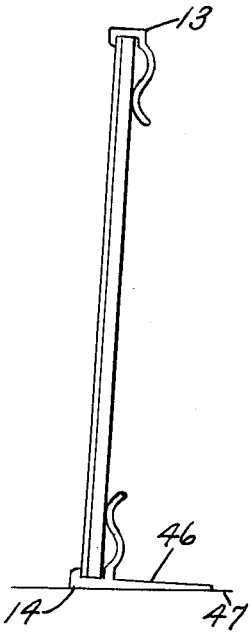
FIG. 6
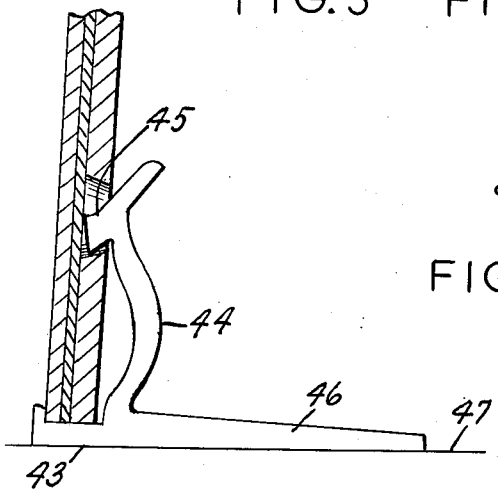
FIG. 7
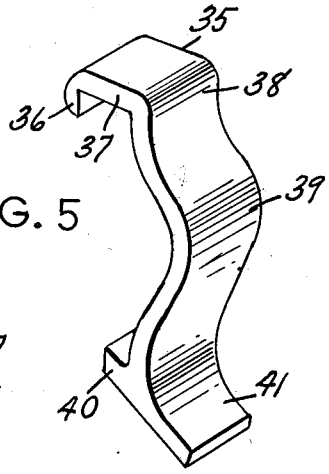
FIG. 5

FIG. 8
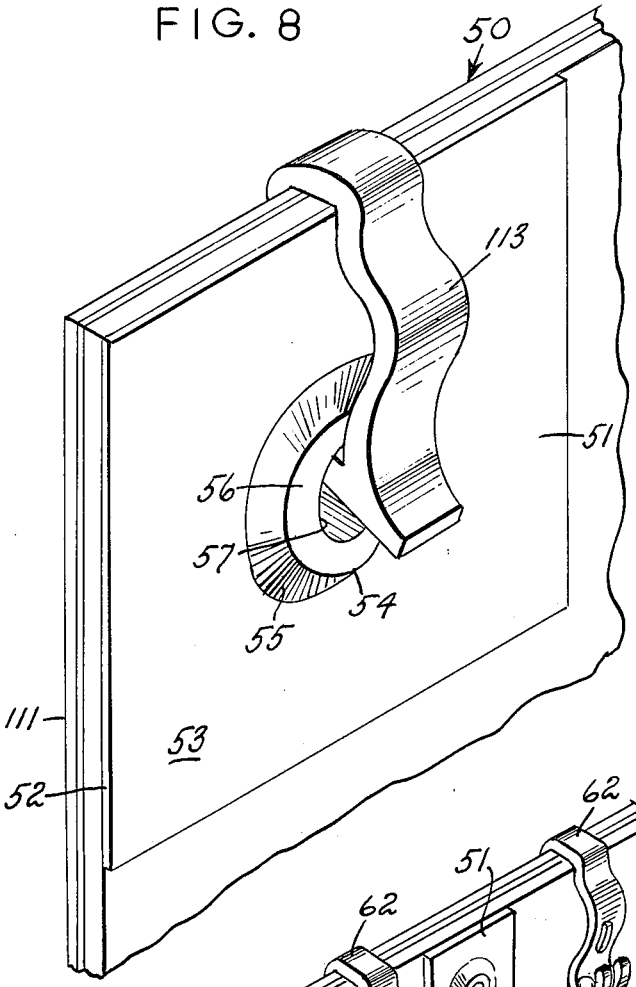
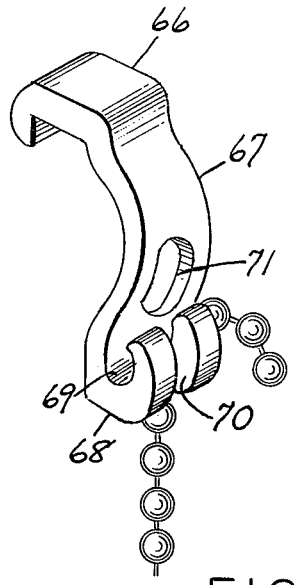
FIG. 10
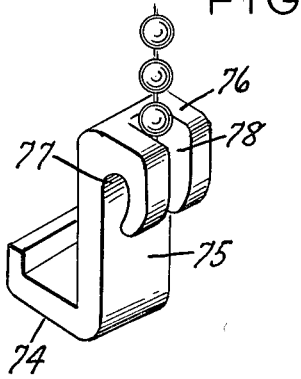
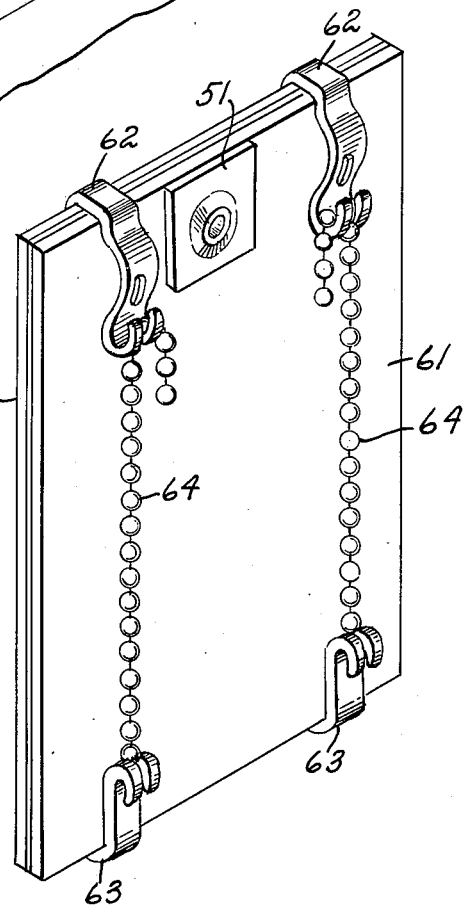
FIG. 9
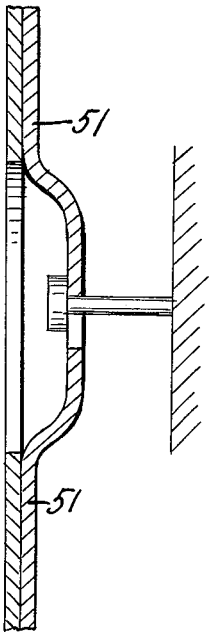
FIG. 11

PICTURE FRAME CONSTRUCTION

BACKGROUND OF THE INVENTION

This invention relates to picture frame construction of a type permitting borderless display of a photograph or print by maintaining a transparent front panel in congruent relation with respect to a rear panel by a plurality of resilient clips engaging the edge portions of both panels. Devices of this general type are known in the art, and the invention lies in the specific constructional details permitting lower cost of production, improved ease of assembly and disassembly, as well as convenience in installation in a particular location.

It is known, for example, to provide resilient clips to hold front and back panels together, and support a picture or print in enclosed relation, as taught by the patent to Bruck, Jr. U.S. Pat. No. 3,501,714, as well as the patent to Marx, U.S. Pat. No. 3,425,147.

Such devices, however, require extensive hand operations during the manufacture thereof to form grooves in the exposed surface of the rear panel parallel to the edges thereof. Further, considerable manipulation is required on the part of the user to position the clips in proper relation.

Other constructions, such as that exemplified by Kulicke U.S. Pat. No. 3,003,272 involve exceedingly complicated spring linkages, and are very expensive to manufacture.

SUMMARY OF THE INVENTION

Briefly stated, the invention contemplates the provision of an improved picture frame construction of the class described in which the panel-interconnecting hardware has been simplified, as contrasted with prior art devices by providing the exposed surface of the rear panel with orifices at pre-determined locations, into which clip type retaining elements are fitted with a snap action, without the necessity of sliding the retaining elements within machined grooves in the rear surface of the rear panel. The retaining elements may be as readily removed by a simple lifting action on a tab provided for that purpose. In the principal embodiment, the orifices are conveniently punched simultaneously. In an alternate form of the embodiment, the orifices are provided by attaching a separate vacuum-molded member containing the orifice by pressure sensitive adhesive means. In another embodiment, the need for forming the orifices on the exposed surface of the rear panel is eliminated by the interconnection of opposed pairs of retaining elements under tension, using a ball chain.

BRIEF DESCRIPTION OF THE DRAWINGS

In the drawings, to which reference will be made in the specification, similar reference characters have been employed to designate corresponding parts throughout the several views.

FIG. 1 is a rear perspective view of a first embodiment of the invention.

FIG. 2 is a front elevational view of the first embodiment.

FIG. 3 is an enlarged fragmentary vertical sectional view corresponding to the upper left-hand portion of FIG. 1, showing a first step in the installation of a resilient retaining element serving to interconnect first and second panels thereof.

FIG. 4 is a similar fragmentary sectional view showing the retaining element in fully installed condition.

FIG. 5 is a view in perspective of a retaining element forming a part of the embodiment.

FIG. 6 is an end view in elevation showing a modification of the first embodiment.

FIG. 7 is a fragmentary enlarged end elevational view corresponding to the lower portion of FIG. 6.

FIG. 8 is a fragmentary rear perspective view showing a second modification of the first embodiment.

FIG. 9 is a rear perspective view of a second embodiment of the invention.

FIG. 10 is a rear perspective view showing a pair of interconnected retaining elements in detached condition.

FIG. 11 is a vertical sectional view corresponding to the upper central portion of FIG. 9.

DETAILED DESCRIPTION OF THE DISCLOSED EMBODIMENTS

In accordance with the first embodiment of the invention, the device, generally indicated by reference character 10, comprises broadly: a transparent front panel 11, an orificed rear panel 12, a first plurality of upper retaining elements 13, and a second plurality of lower retaining elements 14.

The front panel 11 may be formed of glsss, or suitable transparent synthetic resinous material. It is bounded by a lower edge 16, an upper edge 17, side edges 18 and 19, an outer surface 20, an inner surface 21 behind which an enclosed picture 22 (FIG. 2) is positioned.

The rear panel 12 may be formed of planar synthetic resinous material, chip board, paper board or the like, and is similarly configured. It may be either transparent or opaque, and is bounded by a forward surface 24, a rearward surface 25, a lower edge 26, an upper edge 27, and side edges 28 and 29. Through orifices 30 are preferably simultaneously punched as a single mechanical operation to result, as best seen in FIGS. 3 and 4 in the formation of tapered surfaces 31 meeting the rearward surface 25 in a sharp edge 32.

The upper retaining element 13 may be formed by cutting transversely an elongated synthetic resinous extrusion, but are preferably formed by individual injection molding operations. Suitable synthetic resins having the required resiliency are known in the art, as for example polycarbonates, acrylics, and the like. Each retaining element includes a channel forming member 35 having first, second and third walls 36, 37 and 38, respectively. The wall 38 interconnects with an arched resilient member 39 in turn supporting an orifice-engaging hooked member 40 and a manually engageable release member 41. Installation is by manually applying pressure as indicated by arrows in FIGS. 3 and 4, to snap number 40 into orifice 30.

While, as illustrated in FIG. 1, the retaining element 13 may be used for interconnection at both the upper and lower edges of the device 10, as where it will be ultimately mounted upon a wall or other vertical surface, where the device is to be supported upon a horizontal surface, resort is made to the retaining elements 14. These are generally similar to the element 13, including a channel forming member 43, a resilient member 44 and a hooked member 45. In addition, there is provided a rearwardly directed planar extension or foot 46 which will support the device upon a horizontal surface 47.

Turning now to the alternate form of the first embodiment illustrated in FIG. 8 in the drawings, and generally indicated by reference character 50, the punching of orifices directly into the rear panel 12 can be avoided in the event that suitable pressing facilities are unavailable by the provision of a plurality of orifice-forming elements 51 which are formed by vacuum molding from planar synthetic resinous material. Each element includes a forward surface 52 provided with a pressure sensitive adhesive, and a rear surface 53. A recessed portion 54 includes a converging wall 55 and a bottom wall 56 having a centrally disposed orifice 57 therein. The elements 51 are conveniently positioned on the rear surface of the rear panel 12 by the user, by merely aligning a pair of joining edges with converging edges of the panel as shown in FIG. 8 at each corner of the latter.

Turning now to the second embodiment of the invention, illustrated in FIGS. 9 and 10, parts corresponding to those of the principle embodiment have been designated by corresponding reference characters with the additional prefix "1".

The second embodiment includes a front panel 60 as in the first embodiment, and a rear panel 61 as in the alternate form 50 of the first embodiment. These are interconnected by a first plurality of retaining elements 62 and a second plurality of retaining elements 63, the former being interconnected to the latter by a tensioning ball chain.

The retaining elements 62 each include a channel forming member 66, a resilient member 67 and a hooked member 68 forming a transversely extending channel 69 and a longitudinally extending channel 70. If desired, an orifice 71 extending through the plane of the resilient member 67 may be provided for engagement with a picture cord or similar hanging device.

The retaining elements 63 include a channel forming member 74, an interconnecting member 75, and a hooked member forming a transverse channel 77 and a longitudinal channel 78. It will be understood by those skilled in the art that the retaining elements 63 may be replaced by a second set of retaining elements 62, where greater resiliency is desired.

Assembly of the second embodiment is similar to that in the first embodiment, except that the chain 64 is first interconnected to the retaining element 63 of the each opposed pair, and engaged with the corresponding retaining element 62 while pressing downwardly on the resilient portion of the latter. It will be understood that the retaining elements 63 may be modified, if desired, by including an extension corresponding to the foot 46 of the element 14 in the first embodiment. A centrally disposed orifice forming element 51 may also be positioned as shown in FIG. 9 to provide means for hanging the device from a single nail (see FIG. 11).

I wish it to be understood that I do not consider the invention limited to the precise details of structure shown and set forth in this specification, for obvious modifications will occur to those skilled in the art to which the invention pertains.

I claim:

1. In a picture frame construction of a type including a transparent front panel element, a rear panel element, and clip means for interconnecting said front and rear panel elements in congruent relation to enclose a print or picture, the improvement comprising: said clip means including integrally molded synthetic resinous retaining elements, each having a channel forming member engaging the exposed surfaces of said front and rear panels at juxtaposed edges thereof, an elongated resilient portion interconnected to a portion of said channel-forming member, and a hooked member interconnected to said resilient member, said rear panel having a circular recess extending inwardly from an outer surface thereof for engaging said hooked member to thereby simultaneously position said retaining elements relative to said juxtaposed front and rear panels and place said resilient member thereof under tension; said orifices being incorporated in separate planar members adhesively affixed to said rear panel in desired locations.

2. Structure to acccordance with claim 1, in which said separate planar members are formed as a result of a vacuum molding operation, and in which the orifices are located in dished portions thereof, said dished portions extending outwardly of said rear panel.

* * * * *